US010259636B2

(12) United States Patent
Welch et al.

(10) Patent No.: US 10,259,636 B2
(45) Date of Patent: Apr. 16, 2019

(54) CONTAINER

(71) Applicants: Charlotte Welch, Winchester (GB); Brian Welch, Winchester (GB); Sally Welch, Winchester (GB)

(72) Inventors: Charlotte Welch, Winchester (GB); Brian Welch, Winchester (GB); Sally Welch, Winchester (GB)

( * ) Notice: Subject to any disclaimer, the term of this patent is extended or adjusted under 35 U.S.C. 154(b) by 218 days.

(21) Appl. No.: 15/591,479

(22) Filed: May 10, 2017

(65) Prior Publication Data

US 2018/0327168 A1 Nov. 15, 2018

(51) Int. Cl.
*A45D 24/00* (2006.01)
*B65D 81/32* (2006.01)
(Continued)

(52) U.S. Cl.
CPC ..... *B65D 81/3266* (2013.01); *A45D 24/00* (2013.01); *A45D 34/042* (2013.01);
(Continued)

(58) Field of Classification Search
CPC ..... B65D 81/3261; B65D 81/3266; B65D 81/3272
(Continued)

(56) References Cited

U.S. PATENT DOCUMENTS 4,057,047 A 11/1977 Gossett
4,211,019 A 7/1980 McCafferty
(Continued)

FOREIGN PATENT DOCUMENTS

EP 0 612 673 8/1994
EP 0 688 726 12/1995
(Continued)

OTHER PUBLICATIONS

Examination Report under Section 18(3) dated Jul. 5, 2016 in United Kingdom Patent Application No. 1517861.9.
(Continued)

*Primary Examiner* — David Walczak
*Assistant Examiner* — Joshua Wiljanen
(74) *Attorney, Agent, or Firm* — William H. Bollman

(57) ABSTRACT

A container (1) with separate sealed compartments for different substances. The container (1) comprises separate and relatively sealed first (A), second (B) and third (C) compartments. The first compartment (A) receives a first substance (such as colorant); the second compartment (B) receives a second substance (such as a developing solution); and the third compartment (C) defines a mixing volume for receiving the first and second substances from the first and second compartments. A rupturable portion adjoins the third compartment (C) and separates the first and second compartments (A, B), from the third compartment so that in use, when the a rupturable portion is ruptured substances from the first and second compartments (A, B) can pass to the third compartment (C). A passage (16) is provided in a wall of the third compartment (C) along an edge not shared with either of the first or second compartments. The passage (16) leads to a first opening that is opened by a first opening means (6) which when opened, permits controlled release of a user defined amount of the first and/or second substances; and the third compartment (C) has a second opening with a second opening means (66) which enables at least one of the sheets to be opened in order to access the third compartment (C) and remove first and/or second substances therefrom.

17 Claims, 8 Drawing Sheets

(51) Int. Cl.

| | |
|---|---|
| ***B65D 75/52*** | (2006.01) |
| ***B65D 75/58*** | (2006.01) |
| ***B65D 75/56*** | (2006.01) |
| ***B65D 75/26*** | (2006.01) |
| ***B65D 47/42*** | (2006.01) |
| ***A45D 34/04*** | (2006.01) |
| ***A45D 37/00*** | (2006.01) |
| ***A45D 40/00*** | (2006.01) |

(52) U.S. Cl.
CPC ..... *A45D 37/00* (2013.01); *A45D 40/0087* (2013.01); *B65D 47/42* (2013.01); *B65D 75/26* (2013.01); *B65D 75/522* (2013.01); *B65D 75/566* (2013.01); *B65D 75/5811* (2013.01); *B65D 75/5816* (2013.01); *A45D 2200/058* (2013.01)

(58) Field of Classification Search
USPC ..... 401/132–135
See application file for complete search history.

(56) References Cited

U.S. PATENT DOCUMENTS

| | | | | |
|---|---|---|---|---|
| 4,952,068 | A * | 8/1990 | Flint | B01F 5/0602 206/219 |
| 5,755,330 | A | 5/1998 | Siragusa et al. | |
| 7,021,848 | B1 | 4/2006 | Gruenbacher et al. | |
| 2007/0084887 | A1 | 4/2007 | Schelbach | |
| 2007/0246379 | A1 | 10/2007 | Kuenzel | |
| 2009/0142006 | A1 | 6/2009 | Wine et al. | |

FOREIGN PATENT DOCUMENTS

| | | |
|---|---|---|
| FR | 2876356 | 4/2006 |
| GB | 2 482 212 | 1/2012 |
| GB | 2 531 047 | 4/2016 |
| GB | 2 532 130 | 10/2016 |
| WO | 91/18804 | 12/1991 |
| WO | 2007/046744 | 4/2007 |
| WO | 2008/021641 | 2/2008 |
| WO | 2013/087466 | 6/2013 |

OTHER PUBLICATIONS

Combined Search and Examination Report under Sections 17 and 18(3) dated Mar. 8, 2016 in United Kingdom Patent Application No. 1517861.9.

Combined Search and Examination Report under Sections 17 and 18(3) dated Mar. 20, 2015 in United Kingdom Patent Application No. 1417846.1.

* cited by examiner

CONTAINER

FIELD OF THE INVENTION

The present invention relates to a container, more particularly the invention relates to a container with separate sealed compartments. The container is suitable for containing substances in the separate sealed compartments and has at least one rupturable portion to permit selective mixing of the substances to form a composition.

BACKGROUND

There is often a requirement for substances that require mixing to form a composition, to be stored separately until use. In some situations it may be necessary to contain small tester amounts or samples in order to permit a trial of the contents before purchase of a larger amount. For some substances, such as hair dyes, cosmetics or topical applications it may be recommended to test a small amount of the substance or composition prior to application or use.

For example there is a large current market for hair dyes, both for professional colouring carried out at hair salons and for private use. Permanent hair dye, containing para-phenylenediamine (PPD), usually consists of two elements that are mixed immediately prior to use: a colourant, and a developer. The hair colouring process can be potentially dangerous causing contact dermatitis, anaphylactic shock and in, albeit rare and extreme cases, death. This is due to the chemicals commonly used in the colourants, developers, or when both are combined. Problems can be exacerbated by the lack of experience and training of the users handling the products.

Most manufacturers recommend that their products are tested on an individual on which they are to be used, typically a day or so before the product is used, each time the product is used. However existing products do not provide a means to carry out a patch test of product without opening the packaging that contains the container(s) and then opening the containers that hold the full amounts. Testing helps to indicate whether the user will or will not have an adverse reaction. Testing every time is recommended as a user's tolerance to the chemicals can change due to the use of drugs (pharmaceutical or recreational), diet, age, tattoos, black henna tattoos, the use of sunscreen and other personal circumstances.

Manufacturers are continuously adjusting the product for marketing, competitive and technical purposes. Test guidelines generally specify that the test should be carried out with the colourant only or a small amount of colourant and developer, depending on the laws of the jurisdiction of use and the particular brand used. Semi-permanent hair dyes also usually require a 48 hour test as some may contain a diluted para-dye, a nitro-dye or an azo-dye within the colourant. Colourant with bleaching booster powders and the developer also recommend a 48 hour test due to the presence of ammonia, hydrogen peroxide and possibly small percentage of the PPD or its derivative.

Allergy UK—an organisation based at www.allergyuk.org—recommend a 48 hour patch test as 'cross-reactivity' can occur in a moderate number of patients who have become sensitised to one of the aforementioned chemicals. US Food and Drug Administration also provides guidance on safety issues relating to use of cosmetic products such as hair dye and encourages skin tests before every use—https://www.fda.gov/cosmetics/productsingredients/products/ucm143066.htm If there is more than one product, or more than one composition, separate tests for each product or composition are recommended.

PRIOR ART

U.S. Pat. No. 4,534,509 (Holzner) describes and shows a plastic packing device for the storage and the delivery of active materials. The device consists of multiple compartments destined to accommodate liquid, solid or gel materials. The compartments are formed by joining two flexible polymeric sheets and comprising at least one sealed storage compartment impervious to the active materials and a sealed compartment for receiving a product.

U.S. Pat. No. 7,252,091 (Wayne at al) describes and shows a hair colorant device that is capable of separately housing two volatile hair colorant solutions. The hair colorant device has two compartments used to store. Introduce and mix the hair colorant solutions. When combined the two hair colorant solutions may be applied to a person's hair.

WO2003091127 (Colour Test Ltd) describes and shows an apparatus for testing hair products. A multi-chamber sachet is provided with each chamber containing a mutually reactive agent of the hair product. A low strength seal between the chambers permits easy breakage and combining of contents. The sachet contents can then be used to provide a patch test for allergies, a compatibility test and/or a colour test for colourants, dyes and bleach hair products. The sachet provides quick and convenient testing prior to full use of the hair product.

EP0612672 (Stupar) discloses a package for housing and mixing two materials.

US2009142006 (Wine) discloses a multi-compartment bag comprising a front sheet and a back sheet that are affixed to each other along adjacent peripheral edges.

EP0688726 (Stupar) discloses a plural compartment package for housing and storing two different materials.

U.S. Pat. No. 5,755,330 (Siragusa) discloses a package for containing two automatic toilet bowl cleaners.

U.S. Pat. No. 4,057,047 (Gossett) discloses a thermal pack with ingredients for making either a cold or hot pack.

FR287635 (Winckeis) discloses a double sachet the device having a channel emerging in bags via openings.

WO2013087466 (Schlarp) discloses a bag made of plastic film which when open can be filled with at least one product.

GB2482212 (Robinson) discloses a dispensing device for a multi-compartment composition comprising a cylindrical or sleeve like housing.

U.S. Pat. No. 4,211,019 (McCafierty) discloses a flexible bladder shaped as an inner sole.

U.S. Pat. No. 7,021,848 (Gruenbacher) discloses a semi-enclosed applicator for distributing a substance.

US2007/0084887 (Schelback) discloses a plastic bottle-type container with at least two adjacent chambers.

US20070246379 (Kuenzel) discloses a flexible pouch beverage container with one or more extra compartments.

US20090142006 (Wine et al) discloses a multicompartment bag comprising a front sheet and a back sheet that are affixed to each other.

WO9118804 (O'Reilly) discloses a single use dispensing sachet and method of and means for manufacture of the same.

WO2007046744 (Gambro) discloses a flexible multi-compartment container for storage and mixing.

WO2008021641 (Gayton) discloses a device and method for colouring hair.

There is therefore a need for a container that permits selective internal mixing and controlled release of contents. For example for a test-use container for hair colourant that is easy and accurate to use and which contains a sample of product suitable for patch testing, and for testing on a hair sample. The present invention seeks to address one or more of these needs.

SUMMARY OF THE INVENTION

According to a first aspect of the present invention there is provided a container with separate sealed compartments suitable for receiving substances for mixing by a user, the container comprises: separate and relatively sealed first, second and third compartments defined by walls between upper and lower sheets; the first compartment receives and stores a first substance; the second compartment receives and stores a second substance; and the third compartment defines a mixing volume for receiving the first substances from the first compartment when a wall in the first compartment is ruptured and the second substance from the second compartment when a wall in the second compartment is ruptured; a passage is provided in a wall of the third compartment along an edge not shared with either of the first or second compartments, the passage leading to a first opening that is opened by a first opening means which when opened, permits controlled release of a user defined amount of the first and/or second substances; and the third compartment has a second opening with a second opening means which enables at least one of the sheets to be opened in order to access the third compartment and remove first and/or second substances therefrom.

The container is suitable for use with any suitable selection of substances that require mixing for example for hair colourant, skin products such as moisturisers or makeup, or topical applications. For example the container may contain hair colourant, which may contain sufficient colourant and developer for test use for a patch test only and/or on a strand of hair.

In this way the substances of the first and second compartments are isolated by a wall that is defined by the sheets until use. When the mixture is required for use a user can selectively mix the contents by rupturing the rupturable portions to permit mixing within the container.

This ensures the mixed composition is suitable for use, for example having the correct potency that may change over time when mixed.

The container enables predetermined amounts of substances to be mixed to form a composition for a single use application. The container can then be disposed of. Importantly as the substances are contained within the container they are not exposed to the air or each other which can affect some substances over time.

Additionally the container may be formed from a material that does not allow light to pass through so as to prevent any damage to the substances due to sun damage.

The container may be used for any substances that require mixing before use. Typically the container is used for hair colourants, cosmetics, make-up, food stuff or medications, wherein it is preferably to keep the substances separate until use. For example, an active ingredient in a moisturiser such as Vitamin C, may be kept in a separate compartment until use.

In some embodiments the third compartment includes a substance. For example the third compartment may include a bleaching agent that boosts the colourant, or an extra ingredient for a food stuff, such as a salad dressing.

In preferred embodiments each compartment has a volume that corresponds to the to predetermined mixing ratios of the substances contained in the compartments. Advantageously this can make mixing easier as each substance substantially fills the compartment so that application of light force will cause rupture of the rupturable portion which may be difficult to achieve if for example a small amount of substance is provided in a large volume.

In a preferred embodiment the mixing ratio for two substances may be 1 to 1.5. Ideally the compartments holding these substances may be sized to reflect the ratio, for example the two corresponding compartments being divided to have a 60%, 40% split, the compartment equating to 40% of the volume holding 1 part of the first substance and the compartment equating to 60% holding 1.5 parts of the second substance.

Preferably the container is sized to receive substance amounts sufficient to perform a patch test and/or a hair strand test only. Although it is appreciated that the container may be used for other substances and compositions such as food stuffs, cosmetics, topical applications, medications, adhesives and settable solutions wherein the volumes contained will be dependent on the composition to be formed.

Ideally the container is suitable for addition to or supply with a package. For example a package supplying hair dye or treatment may include a container so that a user can perform a patch or strand test prior to full application of the hair dye or treatment. Advantageously this can enable a user test the composition on their skin or hair to ensure they do not react to the composition, for example having an allergic reaction.

In some embodiments, for example the container may be used for eyebrow and eyelash colouring substances enabling only the required amount to be mixed when required rather than having to dispense specific quantities from a large container for mixing which reduces longevity of contents of the large container due to exposure to air.

Advantageously by using the container of the present invention as a test/sample sachet there is no requirement to open the main container that typically contains larger quantities of substance. This can help reduce wastage of substances if for example a user has an undesirable reaction to a substance/composition or does not like the results of testing/sampling the composition.

In this way a user can save contents of unsuitable compositions and return or exchange them and/or is able to purchase the suitable/preferred composition having previously carried out a test or sample.

The first and second compartments include a rupturable portion in the wall so as to enable contents to enter the third compartment through the rupture in the wall so that the substances can mix. In this way mixed composition is dispensed and there is reduced opportunity for unmixed contents to be applied/used by a user.

Advantageously this container when used for containing a tester amount of substances such as patch test allows a user to test the contents without having to purchase and open a full-size container.

The container may be made from strong, durable, stable, lightweight materials. The container may be made from but is not limited to polyethylene terephthalate (PET), aluminium (AU) or polyester (PE).

The upper and lower sheets are joined to form walls that define internal compartments and so as to provide a sealed edge around the container. The points at which the upper and lower sheets are joined providing a seal are the walls of the compartments.

The rupturable portions have weakened walls so that the walls can rupture on application of force. For example the walls may be thinner or formed from a different material. Typically the edge of the sheet has a strong seal that cannot be easily ruptured.

In preferred embodiments, the container comprises film layers configured to form a single three-compartment container. This is a convenient, discrete and easy to form arrangement.

The film layers may be formed from a polyester film. This material is inexpensive, easy to source and strong.

In another embodiment, the polyester film is formed from biaxially-oriented polyethylene terephthalate (BoPET). This material is inexpensive, easy to source has high tensile strength and is chemically stable.

A method of forming the containers typically includes heat-sealing of one or more layers of film. The method of forming the container may include the steps of overlaying a first film sheet onto a second film sheet; heat-sealing the opposed edges of the first and second sheets to form a pocket; feeding colourant in between the layers; heat-sealing the colourant into the pocket(s).

In some embodiments the container may include a third sheet of film arranged over the first film sheet; feeding developing solution in between the first and third polyester film sheets; and heat-sealing the developing solution into the pocket between the layers so that one pocket is arranged within another.

The container includes at least two opening so as to access contents of the container.

Preferably the openings are provided from the third compartment.

In some embodiments additional openings may be provided at the first or second compartments.

Preferably each opening has comprise an opening means such as a weakened section configured to allow the sachet to be easily opened, for example tom or pierced, via the weakened section. This aids a user with opening and dispensing or accessing the sachet contents.

In some embodiments the opening means is a notch formed in one edge of the container. The notch is provided on the third compartment so as to access the mixed composition. This is a simple and reliable way to provide a weakened section.

Preferably the third compartment tapers away from the first and second compartments to define a passage through which controlled release of the contents is achieved from one of the openings.

The passage in the third compartment leads to a sealed opening that is opened by an opening means, for example by tearing open the container at a notch.

The passage is provided in a wall of the third compartment along an edge not shared with either of the first or second compartments. In this way the substances are most likely to be fully mixed before exiting the container.

Once the opening is opened using the opening means the substances from within the container are able to exit the container by passing through the passage and exiting from the opening. A user defined amount of the first and/or second substances is exuded by a user squeezing contents from the container when the first passage is opened by the opening means.

For example the third compartment may be substantially triangular or tapered to define a passage to one of the openings. In this way the substances within the container can be guided through the passage towards the opening and when opened the substance can be selectively exuded by the user urging the substance from the container. The substance may be exuded in drops, a line or as one single mass.

The container has a second opening that permits access to the contents of the third compartment. The second opening is provided so that at least one of the sheets to be opened in order to access the third compartment and remove first and/or second substances therefrom.

Typically the second opening providers an opening that is wider than the first opening so that the sheets can be pulled apart. This arrangement enables contents of the container can be easily accessed for example by use of a tool such as an applicator such as a brush or spatula.

In some embodiments the second opening means may comprise a guide as to where the container can be cut, torn or peeled for example indicated by a cutting line, a perforation or a peel indicator. For example the cutting line may be printed on an external face of the container.

In some embodiments the openings may include a filter to prevent any lumps of substance or any parts of the rupturable portion from being dispensed on to a user. For example if mixing a solid such as bleach powder with a developing liquid any unmixed solids (bleach) would not be able to pass through the filter.

For example the opening may include a mesh that limits passage of lumps of substance or parts of the wall that break free during rupture.

It is appreciated that the overall shape of the container is preferably square or rectangular and the internal volumes and shapes of the compartments may vary, such as the internal volume of the third compartment being triangular.

In some other embodiments the container may be circular, oval shaped, or have curved or angled edges to form a particular shape. For example in some embodiments the container may be shaped to represent the product, such as being the shape of a face, an eye, or of an ingredient, or a food item.

Preferably the edges of the container and of the compartments are heat-sealed together. For example the corners of the container may be heat-sealed together so as to form a triangular internal volume whilst the overall shape appears square/rectangular.

Preferably the container is at least 50 mm×100 mm. Preferably the container has the first opening at the tapered pathway of the third compartment, so as to permit controlled exit of the mixed substance.

In preferred embodiments the container is dimensioned for holding a total volume of 15 ml to 25 ml of substances and preferably a total volume of 20 ml of substances.

It is appreciated that the container may be sized dependent upon contents and their intended use, therefore various shapes and sizes of container may be provided.

In some embodiments the container may include a slot configured for hanging the container on a hook or similar. This allows the container to be stored and displayed easily and in a convenient location.

In some embodiments the container may be provided with a common dividing wall between the first and second compartments that can be broken or ruptured to allow mixing of the contents of the first and second compartments, within the first and second compartments. For example if the first compartment contains a colourant solution and the second compartment contains developing solution, these substances may be mixed before entering the third compartment. This allows a user to keep the contents separated but to mix the contents before dispensing, which helps to reduce the potential for spillage or mess.

In some embodiments the container may include at least one window so as to permit a user to view the contents. This allows a user to assess that the contents have been mixed correctly.

In some embodiments the container may be formed in part or wholly from a transparent or translucent material so that mixing of contents can be readily assessed.

In some embodiments the container may include a mixing nozzle configured so that the substances will pass through the nozzle as the container is emptied, and will blend as they pass through the nozzle. This assists with dispensing and mixing the contents ensuring contents are fully mixed.

In another embodiment the container may include a comb or brush to assist a user with application of the contents to skin or a hair sample, without requiring a separate applicator.

In some embodiments the containers may be provided with a display and storage apparatus for receiving one or more of the containers. Typically the apparatus comprises an elongate member comprising a plurality of hooks spaced along the elongate member for receiving the container(s). For example, the elongate member may comprise a plurality of hooks. This allows a vendor or similar to display and store a number of containers in a convenient location.

In yet further embodiments the first compartment may be arranged within the second compartment or vice-versa.

Alternatively the first and second compartments are maintained within the third compartment.

In some embodiments the container is made from recycled materials and preferably the container is capable of being recycled.

Preferred embodiments of the invention will now be made with reference to the Figures in which:

DETAILED DESCRIPTION OF THE FIGURES

Embodiments of the container of the present invention will now be described with reference to the Figures.

FIGS. 1 to 4 shows a container 1 having three separate compartments, A, B and C.

The containers are rectangular with compartments A and B arranged so that both are adjacent to compartment C.

Figure 1:
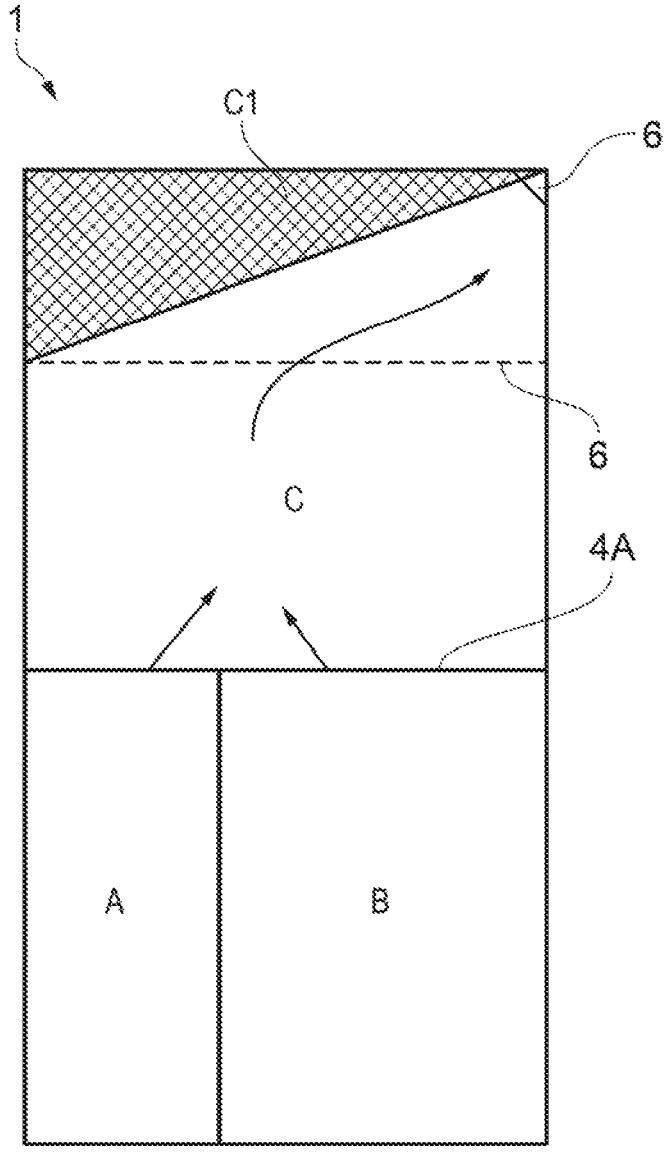
FIG. 1 shows an overview of a preferred embodiment of the container.
Figure 2:
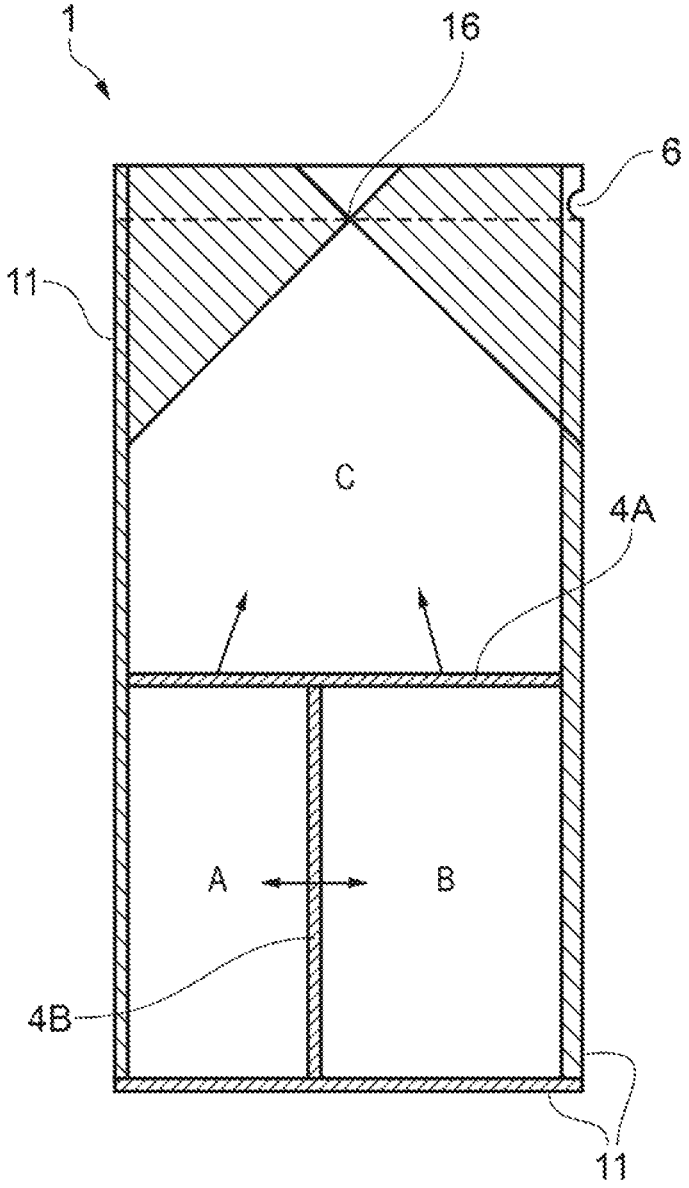
FIG. 2 shows an overview of a second embodiment of a container.

In FIGS. 1 and 2 compartment A has the smallest internal volume. Compartment B has an internal volume larger than compartment A.

Figure 3:
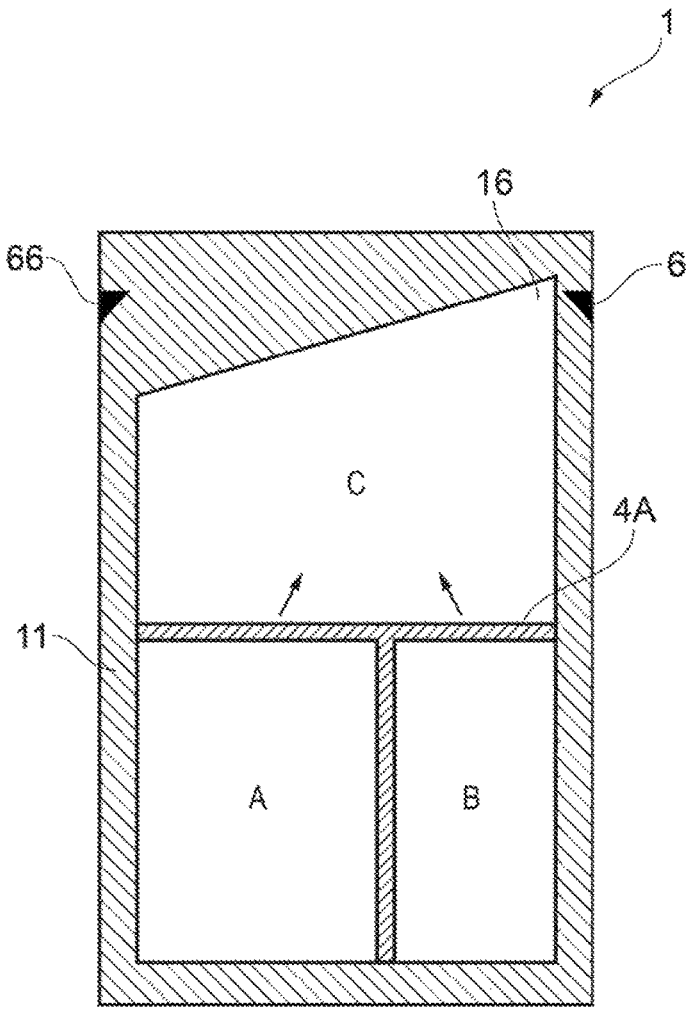
FIG. 3 shows an overview of a third embodiment of a container.
Figure 4:
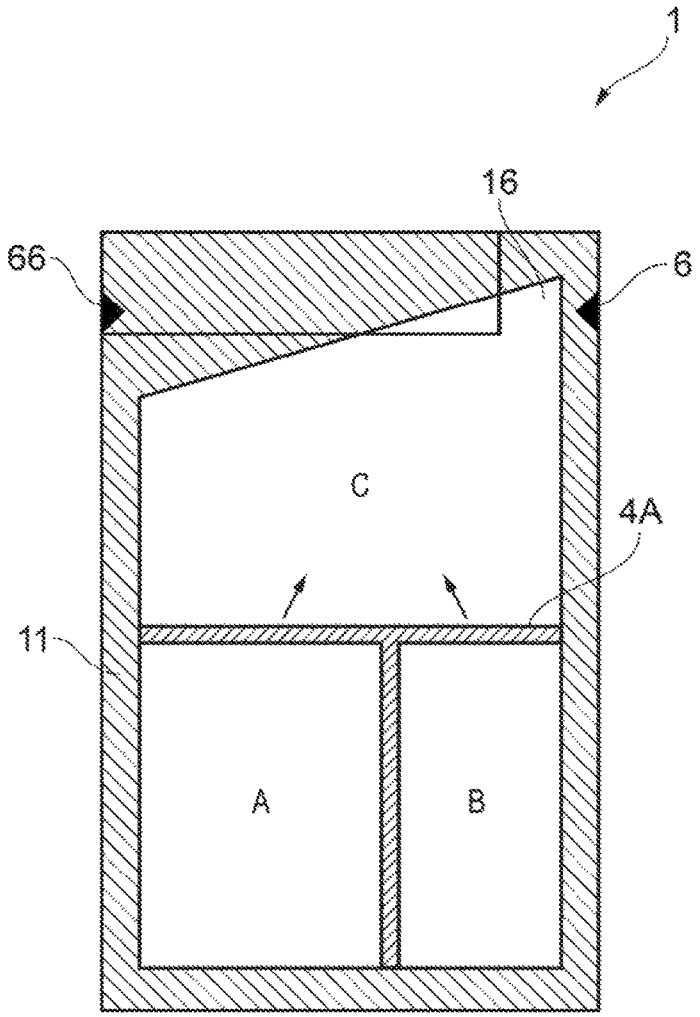
FIG. 4 shows an overview of a fourth embodiment of the container.

In FIGS. 3 and 4 compartment B has the smallest internal volume and compartment A has a larger internal volume than compartment B.

Compartment C is the largest compartment providing a mixing region for the contents or compartments A and B (and optionally the contents of compartment C).

It is appreciated that the volumes of each compartment may vary in different containers so as to be suitable for different substances/compositions and associated mixing ratios.

Compartment C includes an opening means 6 in the form of a tear line which when torn reveals an opening 16 in the form of a pathway through which contents can be exuded.

The pathway 16 is 2 to 3 mm wide so as to permit controlled release of the mixed contents.

In FIG. 1 Compartment C has a second opening means 66 in the form of a cutting line.

In FIGS. 3 and 4 a second opening 66 in the form of a notch is provided to permit a larger opening to be made.

In FIG. 1 the internal volume of compartment C is substantially trapezium shape and the opening is formed at a corner of the third compartment C. The crosshatched region C1 adjacent to compartment C is not capable of containing any contents and forms a barrier to the substances/composition. Typically the crosshatched region C1 is formed from heat-sealing layers of film together or attaching them with adhesive.

This arrangement permits the container to be manufactured from square or rectangular layers of film. The crosshatched region C1 could be cut off during manufacture if required/desired.

In FIGS. 1, 2, 3 and 4 the container has a first rupturable portion 4A arranged between compartment C and compartments A and B. When this ruptures contents from compartments A and B are released into compartment C. Arrows indicate the flow of substances from compartments A and B into C and exiting from C through the tear opening means 6.

In FIGS. 2, 3 and 4 each container has a crosshatched perimeter edge 11 that indicates the sealed edge of the container and defines the outer shape of the container. The perimeter edge also serves to define walls of the compartments A, B and C.

The perimeter edge 11 provides a sealed edge to contain substances within the container. Typically the perimeter edge is formed by a heat-sealing process between the upper and lower sheets.

The opening means 6, 66 in FIGS. 2, 3 and 4 are arranged in the perimeter edge 11.

In some embodiments the wall between compartments A and B may also be rupturable providing a second rupturable portion 4B (see FIG. 2). In this way mixing is permitted freely within the combined volume of the container. In addition to this it is possible to mix the contents of compartments A and B before they enter compartment C.

Figure 5:
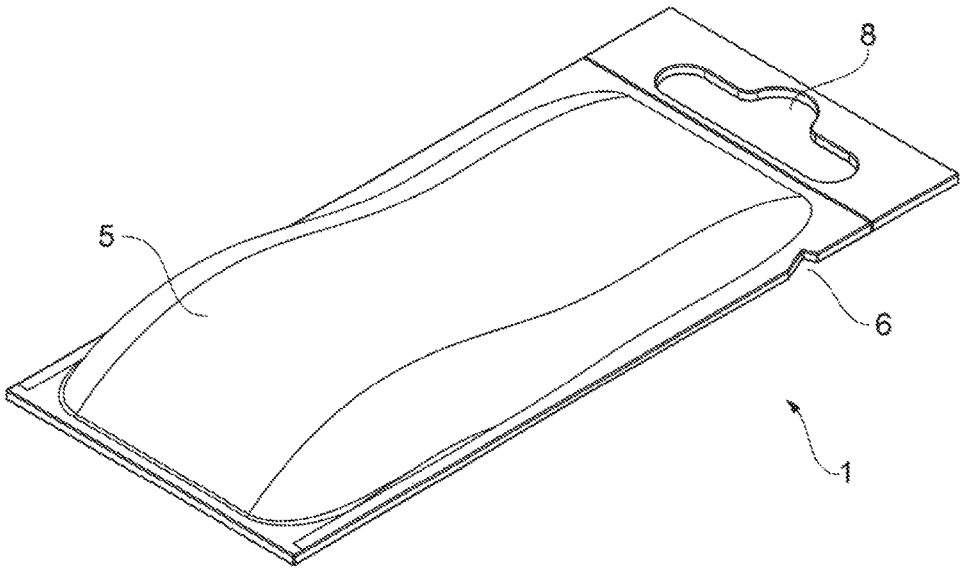
FIG. 5 shows a perspective view of a third embodiment of the invention.

FIG. 5 shows a fifth embodiment of the container 1. The footprint of the container is rectangular. An upper face of the container is arcuate and a lower face of the container is planar.

The container 1 is formed by layering layers of film 5 so that a single container with at least two compartments is provided. In this embodiment, the film layers are formed from a polyester film such as biaxially-oriented polyethylene terephthalate (BoPET), which is known under the trade name Mylar® in some territories. This material provides and inexpensive, easy-to-source and strong material that is highly flexible.

The container has an internal wall 4 formed from the same material to separate the compartments. The internal wall 4 is weakened before forming so that excess and directed squeezing pressure applied to the container 1 will cause the internal wall 4 to rupture, allowing the contents of the compartments (not shown in FIG. 3) to mix.

The third embodiment includes an opening means 6 in the form of a notch so that the container can be readily torn open.

Figure 6:
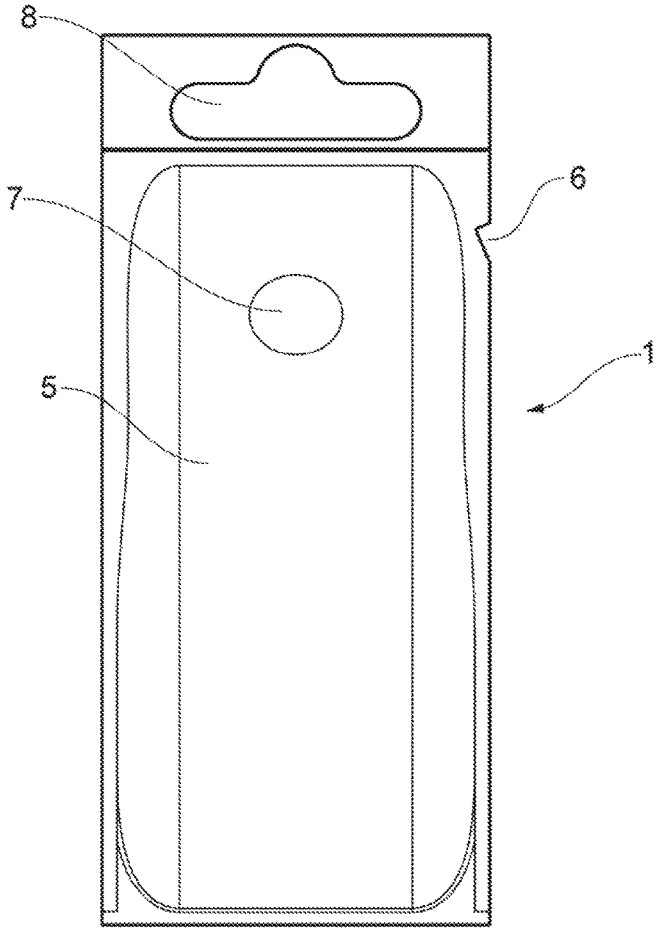
FIG. 6 shows a view from above of the third embodiment.

In FIG. 6 the container is shown having a window section 7 is formed so that a user can view the contents in use, for example to assess if the colourant and developer has mixed.

In some embodiments a spatula or application utensil is provided with the container. In some embodiments the application utensil or applicator may be included internal to the container wherein the application utensil may be displaced fully or partly so as to aid in application.

A notch 6 is formed in one side of the container 1, towards one end. The notch 6 forms a weakened section that allows the container/sachet to be easily tom open via the weakened section. This aids a user with opening and dispensing the container contents.

FIG. 5 shows a perspective view of a third embodiment of the invention with an outer polyester film that forms part of the container. An opening means 6 is a notch formed in one side of the container to provide a weakened section so that the container can be tom open. A slot at one end is provided for hanging the container on a hook or point of sale display panel.

In FIG. 6 the container is shown having a slot 8 formed in one end of the container 1 so that the container can be hung on a hook or similar for storage and/or display.

Figure 8:
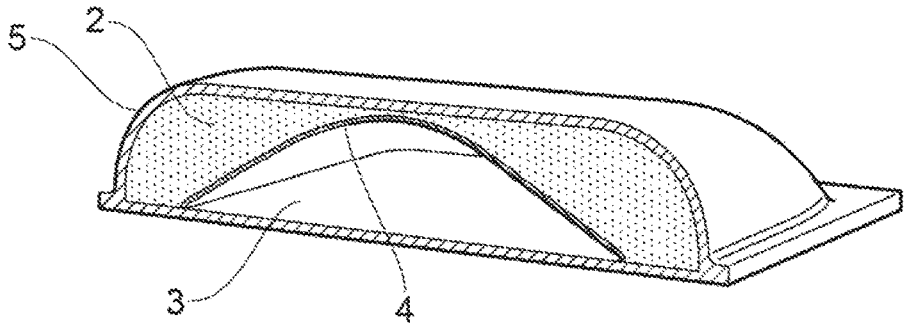
FIG. 8 shows a cutaway cross-sectional view of the third embodiment, showing internal detail of first and second pockets separated by a common internal wall.
Figure 9:
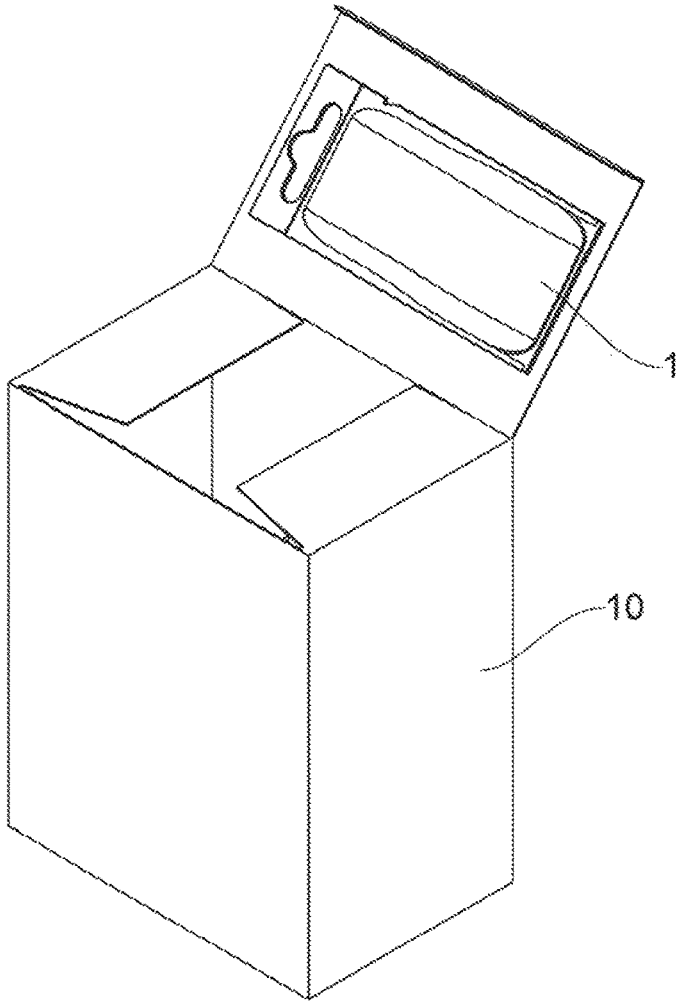
FIG. 9 shows a package of hair treatment product that contains sufficient hair treatment product for colouring a user's hair, and which also contains a separate test-use container as shown in any one of FIGS. 3 to 6.
Figure 10:
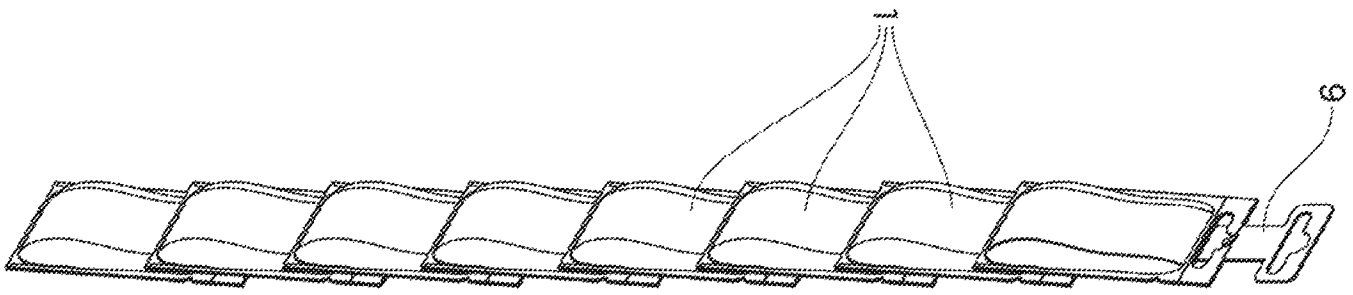
FIG. 10 shows a display and storage apparatus for holding containers.

A display of containers 1 is shown in FIG. 8. A number of containers 1 are hooked onto hooks spaced along the length of an elongate display member 9. This allows a vendor or similar to display and store a number of containers in a convenient location.

Figure 7:
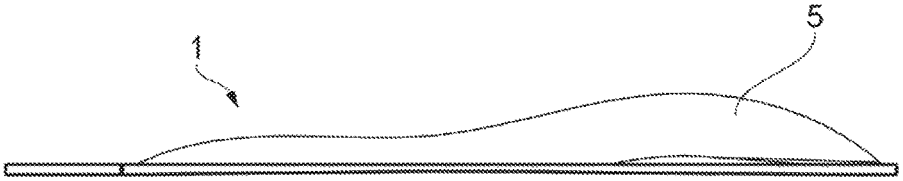
FIG. 7 shows a side view of third embodiment.

FIG. 7 shows a side view of the second embodiment of the container having a flat lower face and an arcuate upper face so as to define an internal volume for the substances to be contained and subsequently mixed. In this way the container can be position on a flat surface and the arcuate surface deformed in order to rupture the rupturable portion.

The containers 1 as described above can be easily and quickly formed by overlaying a first polyester film sheet onto a second polyester film sheet, heat-sealing the opposed edges of the first and second sheets, feeding colourant in between the layers, and heat-sealing the colourant into pockets between the layers.

If required, a third pocket or compartment can be added, for holding bleaching agent booster powder. When the pocket is ruptured internally, the bleaching agent booster powder mixes with the colourant solution and developing solution.

FIG. 8 shows a cross section of a container having a compartment 3 arranged within compartment 2. The internal wall 4 that divides the compartments is rupturable so as to permit mixing when ruptured.

Containers such as container 1 described above can be included as part of a package 10 of hair treatment product as shown in FIG. 6 that contains sufficient hair treatment product for completely colouring a users head of hair.

The container or sachet contents can then be used to provide a patch test for allergies, a compatibility test and/or a colour test for cosmetics, topical applications, colourants, dyes and bleach hair products before deciding whether to use the main contents of the package. The sachet provides quick and convenient testing prior to full use of the hair product.

In other uses the sachet may include ingredients separated into the different compartments that are selectively mixed before eating or drinking the mixture.

The invention has been described by way of examples only and it will be appreciated that variation may be made to the above-mentioned embodiments without departing from the scope of invention as defined by the claims.

The invention claimed is:

1. A container with separate sealed compartments suitable for receiving substances for mixing by a user, the container comprises: separate and relatively sealed first, second and third compartments defined by walls between upper and lower sheets; the first compartment receives and stores a first substance; the second compartment receives and stores a second substance; and the third compartment defines a mixing volume for receiving the first substance from the first compartment when a wall in the first compartment is ruptured and the second substance from the second compartment when a wall in the second compartment is ruptured; a passage is provided in a wall of the third compartment along an edge not shared with either of the first or second compartments, the passage leading to a first opening that is opened by a first opening means which when opened, permits controlled release of a user defined amount of the first and/or second substances; and the third compartment has a second opening with a second opening means which enables at least one of the sheets to be opened in order to access the third compartment and remove first and/or second substances therefrom.

2. A container according to claim 1 wherein the third compartment includes a substance.

3. A container according to claim 1 wherein the first and second compartments have volumes that correspond to predetermined mixing ratios of the substances contained in the first and second compartments.

4. A container according to claim 1 wherein the container comprises film layers configured to define the compartments.

5. A container according to claim 4 wherein the sheets are film layers are formed from a polyester film.

6. A container according to claim 5 wherein the polyester film is formed from biaxially-oriented polyethylene terephthalate (BoPET).

7. A container according to claim 1 wherein the opening means comprises a weakened section configured to allow the container to be easily tom open.

8. A container according to claim 1 wherein the opening means comprises a tear point in the form of a notch located on the third compartment.

9. A container according to claim 1 including a filter.

10. A container according to claim 1 for holding a volume of 15 ml to 25 ml of substances.

11. A container according to claim 1 for holding a volume of 20m of substances.

12. A container according to claim 1 comprising a slot configured for hanging the container.

13. A container according to claim 1 wherein the container is configured with a common dividing wall between the first and second compartment that can be broken to allow mixing of the two substances before the substances enter the third compartment.

14. A container according to claim 1 includes at least one window to allow a user to view contents of one or more compartment(s).

15. A container according to claim 1 includes a mixing nozzle.

16. A container according to claim 1 includes an applicator comprising a comb, brush or spatula.

17. A container according to claim 1 wherein the first and second compartments are maintained within the third compartment.

* * * * *